US007305835B2

(12) United States Patent
Longsworth

(10) Patent No.: US 7,305,835 B2
(45) Date of Patent: Dec. 11, 2007

(54) PULSE TUBE COOLING BY CIRCULATION OF BUFFER GAS

(75) Inventor: Ralph C. Longsworth, Allentown, PA (US)

(73) Assignees: SHI-APD Cryogenics, Inc., Allentown, PA (US); Sumitomo Heavy Industries, Ltd., Tokyo (JP)

( * ) Notice: Subject to any disclaimer, the term of this patent is extended or adjusted under 35 U.S.C. 154(b) by 402 days.

(21) Appl. No.: 10/500,786

(22) PCT Filed: Jan. 8, 2003

(86) PCT No.: PCT/US03/00381

§ 371 (c)(1),
(2), (4) Date: Jul. 2, 2004

(87) PCT Pub. No.: WO03/058666

PCT Pub. Date: Jul. 17, 2003

(65) Prior Publication Data

US 2005/0000232 A1 Jan. 6, 2005

Related U.S. Application Data

(60) Provisional application No. 60/346,701, filed on Jan. 8, 2002.

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | |
|---|---|---|---|---|
| 5,720,172 | A * | 2/1998 | Ishizaki | 62/6 |
| 5,966,942 | A * | 10/1999 | Mitchell | 62/6 |
| 5,966,943 | A | 10/1999 | Mitchell | |
| 6,094,921 | A | 8/2000 | Zhu et al. | |
| 6,256,998 | B1 * | 7/2001 | Gao | 62/6 |
| 6,351,954 | B1 | 3/2002 | Nogawa et al. | |
| 6,434,947 | B2 * | 8/2002 | Zhu et al. | 62/6 |
| 6,637,211 | B1 * | 10/2003 | Swift et al. | 62/6 |

FOREIGN PATENT DOCUMENTS

| | | |
|---|---|---|
| JP | 04-225755 | 8/1992 |
| JP | 404225755 A * | 8/1992 |

* cited by examiner

*Primary Examiner*—William C Doerrler
(74) *Attorney, Agent, or Firm*—Katten Muchin Rosenman LLP

(57) ABSTRACT

The present invention applies to single or two stage pulse tube refrigerators that have one or more passive orifices at the hot end(s) of the pulse tube(s) through which gas flows to achieve phase shifting and the phase shifting gas flow circulates to a remote heat sink by adding check valves and an appropriate piping circuit.

8 Claims, 4 Drawing Sheets

PULSE TUBE COOLING BY CIRCULATION OF BUFFER GAS

This application is the National Stage of International Application No. PCT/US03/00381, filed Jan. 8, 2003, which claims the benefit under 35 U.S.C. 119(e) of U.S. Provisional Application No. 60/346,701, filed Jan. 8, 2002.

BACKGROUND OF THE INVENTION

The Gifford-McMahon (G-M) type pulse tube refrigerator is a cryocooler, similar to G-M refrigerators, that derives cooling from the compression and expansion of gas. However, unlike the G-M systems, in which the gas expansion work is transferred out of the expansion space by a solid expansion piston or displacer, pulse tube refrigerators have no moving parts in their cold end, but rather an oscillating gas column within the pulse tube (called a gas piston) that functions as a compressible displacer. The elimination of moving parts in the cold end of pulse tube refrigerators allows a significant reduction of vibration, as well as greater reliability and lifetime, and is thus potentially very useful in cooling cryopumps, which are often used to purge gases from semiconductor fabrication vacuum chambers, to 10 K.

G-M type pulse tube refrigerators are characterized by having a compressor that is connected to a remote expander by high and low pressure gas lines. The expander has a valve mechanism that alternately pressurizes and depressurizes the regenerators and pulse tubes to produce refrigeration at cryogenic temperatures.

G-M type pulse tube refrigerators that operate below 20 K have the disadvantage of requiring that the hot end of the pulse tube be above the cold end in order to avoid the thermal losses associated with convective circulation within the pulse tube. Conventional two-stage GM type pulse tube refrigerators typically have the valve mechanism and the hot end of the pulse tube on top. This enables the heat that is rejected at the hot end of the pulse tube to be easily transferred to the low-pressure gas and returned to the compressor where it is rejected. Conventional two stage pulse tube refrigerators also require a relatively large buffer volume(s). Two stage G-M refrigerators, which are presently being used to cool cryopumps, require no buffer volume and can be mounted in any orientation.

Most cryopumps are mounted below the vacuum chamber where space above the cryopump housing is very limited. Having the valve mechanism above the cryopump housing limits the applications of the cryopump. Thus, any options to orient the pulse tube refrigerator with the valve behind or below a cryopump housing that has a side inlet are highly desirable. Minimizing the size of the buffer volumes is also desirable. Separating the hot end of the pulse tube from the valve introduces the problem of removing the heat that has to be rejected at the hot end of the pulse tube.

The present invention address the need to remove heat from the hot end of the pulse tube when it is remote from the valve.

C. K. Chan, C. B. Jaco, J. Raab, E. Tward, and M. Waterman, in a paper titled "Miniature pulse tube cooler", Proc.7th Int'l Cryocooler Conf., Air Force Report PL-CP—93-1001 (1993) pp. 113-124, describe a Stirling single stage pulse tube that is inline, thus the hot end of the pulse tube is remote from the regenerator inlet. It has double orifice control. Heat from the hot end of the pulse tube and buffer are rejected to the base at the regenerator inlet by conduction through the buffer housing which extends the full length of the pulse tube. The hot end of the pulse tube is not attached to the vacuum housing so the entire pulse tube assembly can be easily removed.

The object of this invention is to provide an improved means of removing heat from the hot end of a pulse tube refrigerator when it is remote from the warm end of the regenerator. While the primary application for this invention is the cooling of cryopumps by GM type pulse tube refrigerators it is equally applicable to Stirling type pulse tube refrigerators when heat has to be transferred from the pulse tube to a remote sink.

SUMMARY OF THE INVENTION

The present invention applies to single or two stage pulse tube refrigerators that have one or more passive orifices at the hot end(s) of the pulse tube(s) through which gas flows to achieve phase shifting. Advantage is taken of this gas flow to have it circulate to a remote heat sink by adding check valves and an appropriate piping circuit. The piping may have enough volume to serve as the buffer volume and the gas may flow through the buffer volume, rather than to simply flow in and out of the buffer volume.

DESCRIPTION OF THE INVENTION

The present invention is a means of cooling a pulse tube refrigerator in which the hot end of the pulse tube is remote from the line that connects the compressor to the warm end of the regenerator. It applies to GM type pulse tubes which achieve pressure cycling by means of a valve mechanism that alternately supplies high pressure gas from the discharge side of a through-flow compressor and returns gas to the inlet side of the compressor at low pressure. It also applies to Stirling type pulse tubes in which the compressor piston cycles gas directly to and from the pulse tube.

Figure 1:
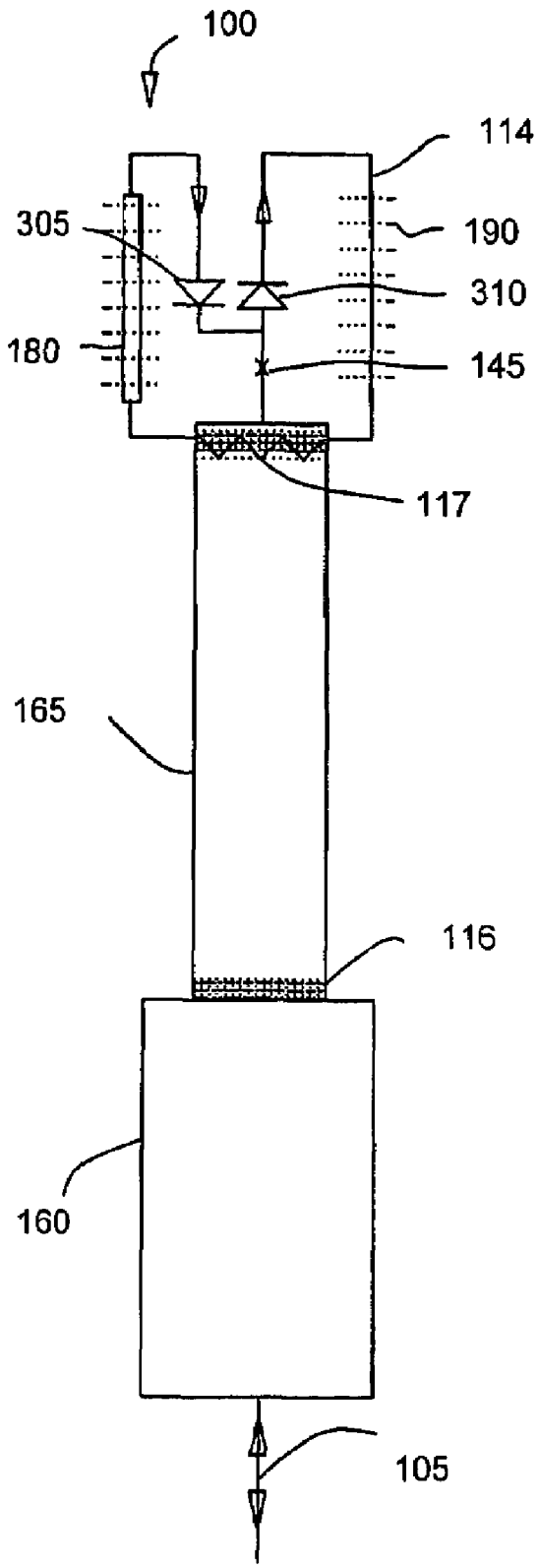
FIG. 1 is a schematic of a single stage inline pulse tube refrigerator with single orifice control cooled by buffer gas circulation.

FIG. 1 shows a schematic of a single stage inline pulse tube refrigerator 100, including a connector tube 105, a first stage regenerator 160, a cold station 116, a pulse tube 165, a hot station 117, a restrictor 145, check valves 305 and 310, cooling channel 114, buffer tank 180, and cooling fins 190.

Connector tube 105 cycles gas in and out of the warm end of regenerator 160 in order to pressurize and depressurize the regenerator and pulse tube and produce refrigeration at cryogenic temperature, e.g. <70 K, at cold station 116 in accordance with well established prior art. Connector tube 105 cycles gas from either a through-flow compressor and a pair of valves (GM type), or directly from a reciprocating piston (Stirling type).

Typical operating conditions for a GM type pulse tube are pressures of 300/100 psig (2.2/0.8 MPa) and 2 Hz cycle rate, and 360/185 psig (2.6/1.4 MPa) and 30 Hz for a Stirling type.

FIG. 1 shows a single fixed orifice or restrictor 145 and buffer volume 180, which are essential to achieve phase shifting in the pulse tube to enhance the amount of cooling that is available. Other forms of phase shifting are known that produce different results in different temperature regimes. The important principal that is being illustrated in this simplest case is that pulsating flow into and out of the buffer volume can be rectified by check valves 305 and 310 to produce a circulating flow of gas, through cooling channel 114, that can be used to transport heat from the hot end of the pulse tube, hot station 117, and 180, to be rejected to ambient in cooling fins 190. Cooling fins 190 are taken as including all of the fins along cooling channel 114 and buffer tank 180.

The operation of the single stage pulse tube with a single orifice is now described for the case where it has cooled down and is in steady state.

In the first phase, high-pressure gas flows into the warn end of regenerator 160 and has a relatively smooth flow pattern as it compresses the gas that is ahead of it in the regenerator and pulse tube 165. Flow into the pulse tube is kept smooth by cold station 116 which serves the dual purpose of transferring heat to the cold outgoing flow and smoothing the incoming flow. The gas that is already in the pulse tube does not mix with the incoming flow and can be thought of as a gas piston. The gas in the piston is heated by the pressurization and pushed towards the hot end of the pulse tube. The repeated pressurization of the gas piston from the cold end establishes a temperature gradient in the gas that results in the gas at the cold end being as cold or colder than cold station 116 and the gas at the hot end being hotter than hot station 117. The gas that is referred to as the gas piston never leaves the pulse tube, but the gas that is ahead of it at the hot end of the pulse tube is heated above ambient temperature by the compression, and pushed out of the pulse tube through hot station 117 and restrictor 145. Hot station 117 also serves a dual purpose, first it transfers heat from the hot gas flowing out of the pulse tube to the heat station housing, and second it smoothes the flow when it flows back into the pulse tube.

In phase 2 gas flow out of the hot end of the pulse tube at high pressure causes the gas piston to draw in gas at the cold end. Buffer tank 180 is typically at a pressure intermediate to the high and low pressures so gas flows into it when the pressure in the pulse tube is high and gas flows out of it when pressure in the pulse tube is low.

In phase 3 the pressure at the warm end of regenerator 160 is reduced to low pressure and gas flows out of the regenerator and pulse tube. The regenerator is a periodic heat exchanger, that is, it removes heat from the gas and cools it to about the temperature of cold station 116 during the high pressure phase, then it is cooled by the out flowing gas and warms the gas to neat ambient temperature as it leaves the regenerator during the low pressure phase. The gas piston expands and cools as it drops in pressure and flows back towards the cold end.

In phase 4 gas flows into the hot end of the pulse tube through restrictor 145 and hot station 117 and pushes out the remaining cold gas that is below the gas piston. The gas leaving the pulse tube is colder than the gas when it enters, so heat can be transferred from an external heat source at low temperature to cold station 116.

The amount of cooling that is produced is equal to the area of a pressure-volume diagram for the gas that enters and leaves at the cold end of the pulse tube. This same energy is transferred to the hot end of the pulse tube and must be removed at a temperature as close to ambient as possible to have good efficiency. The amount of cooling is optimized by the proper setting of restrictor 145. Other phase shifting mechanisms are available that are more effective than a single orifice but the cooling principals are the same.

FIG. 1 shows that the pulsating flow into and out of the hot end of the pulse tube and restrictor 145 is rectified by check valves 305 and 310 to produce a circulating flow of gas, through cooling channel 114. Cooling is achieved by one or more of the means shown, including cooling fins on the cooling channels to transfer heat to ambient air (or water, not shown), further receiving heat from the hot station 117, and flowing into buffer tank 180 which may transfer heat to ambient by means of cooling fins 190. Cooling channel 114 may have sufficient volume to serve as the buffer tank and enough surface area to reject heat to the ambient. Just cooling the gas flowing from the hot end may be sufficient so that the hot station does not have to be separately cooled.

Figure 2:
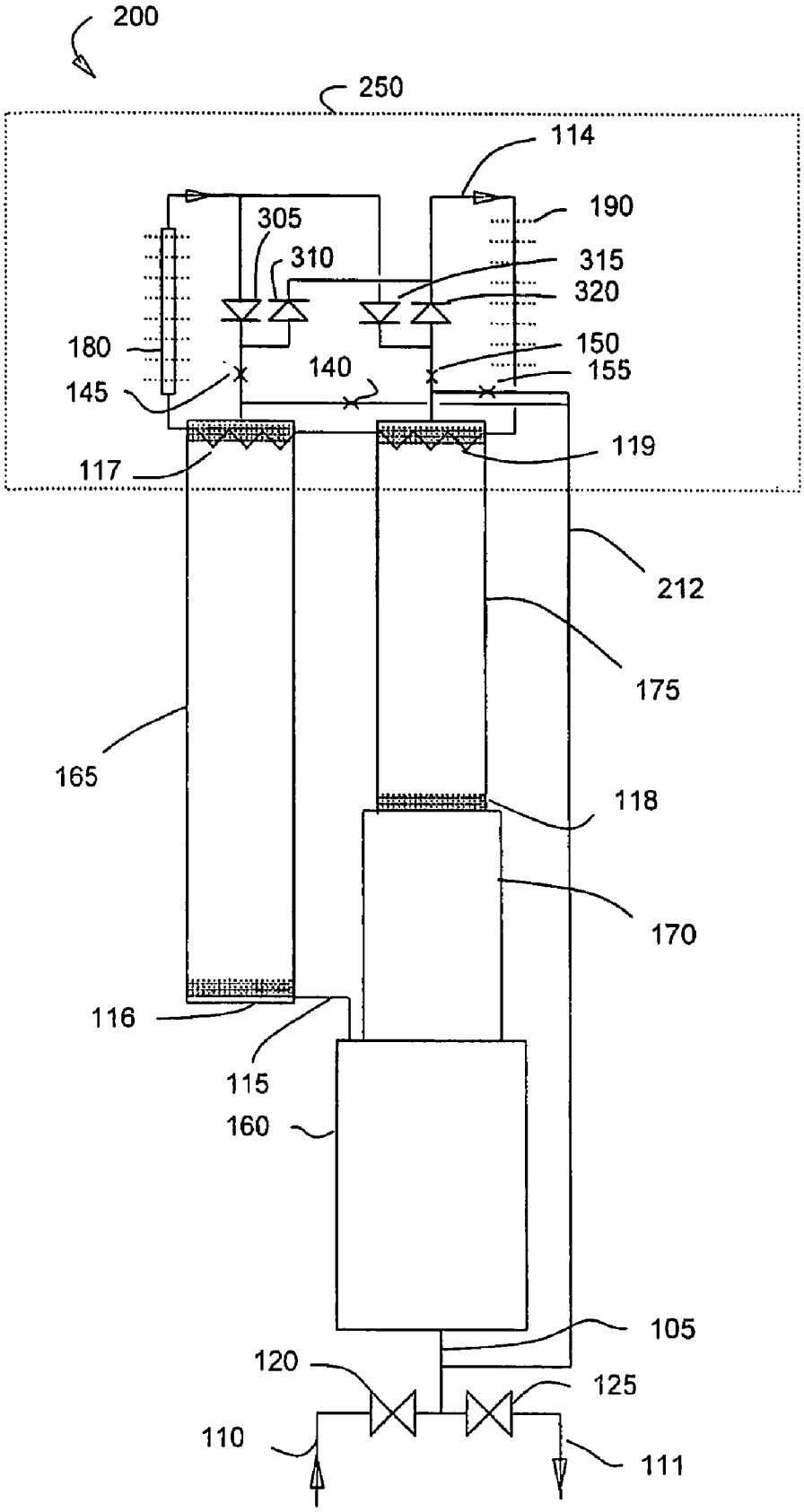
FIG. 2 is a schematic of a two stage inline pulse tube refrigerator with double orifice control and check valves in the piping to the buffer volume to provide cooling by circulation of the buffer gas.
Figure 3:
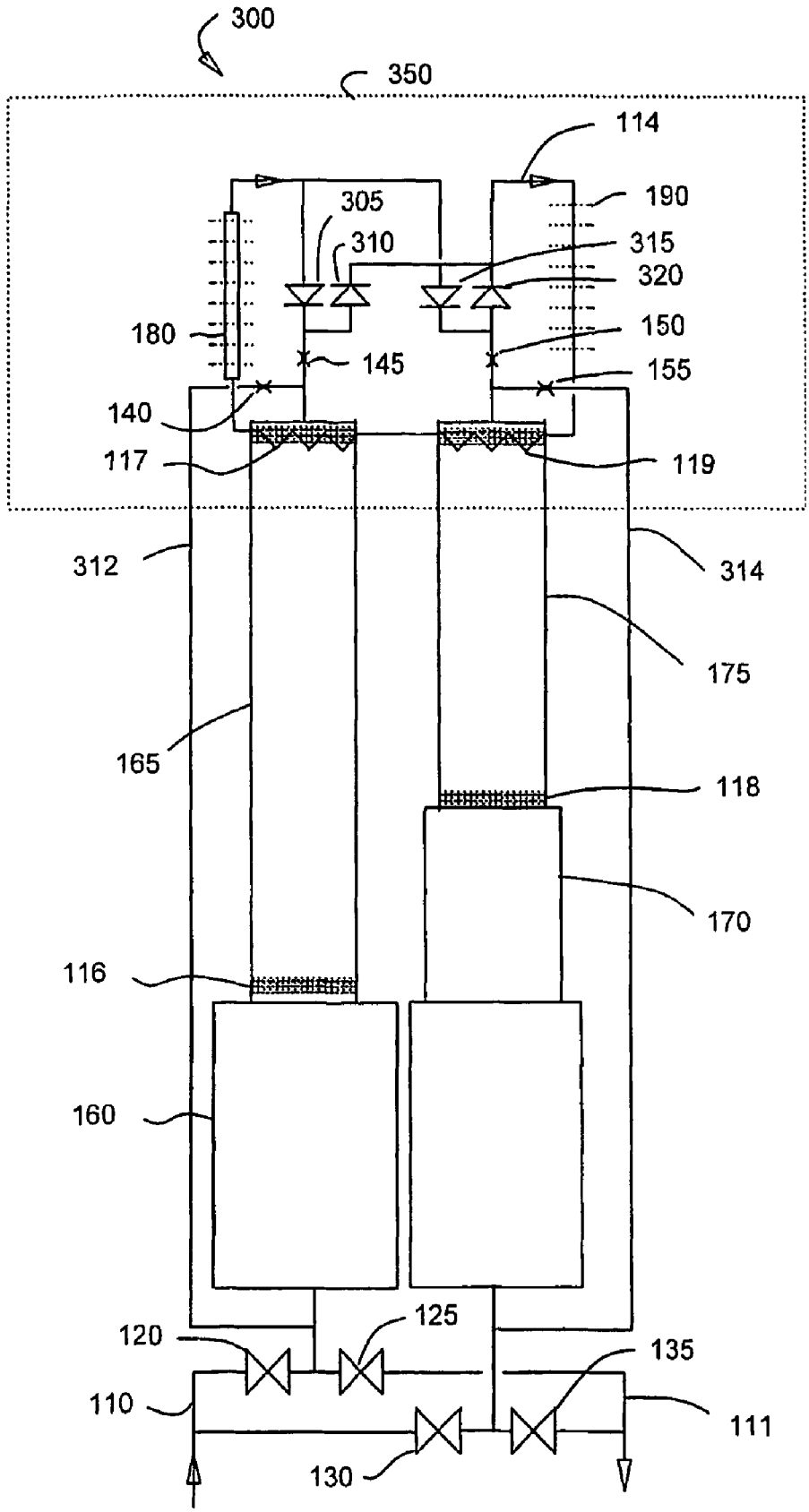
FIG. 3 is a schematic of a two stage inline pulse tube refrigerator with double orifice and interphase control, and check valves in the bypass channel to provide cooling by circulation of the buffet gas.
Figure 4:
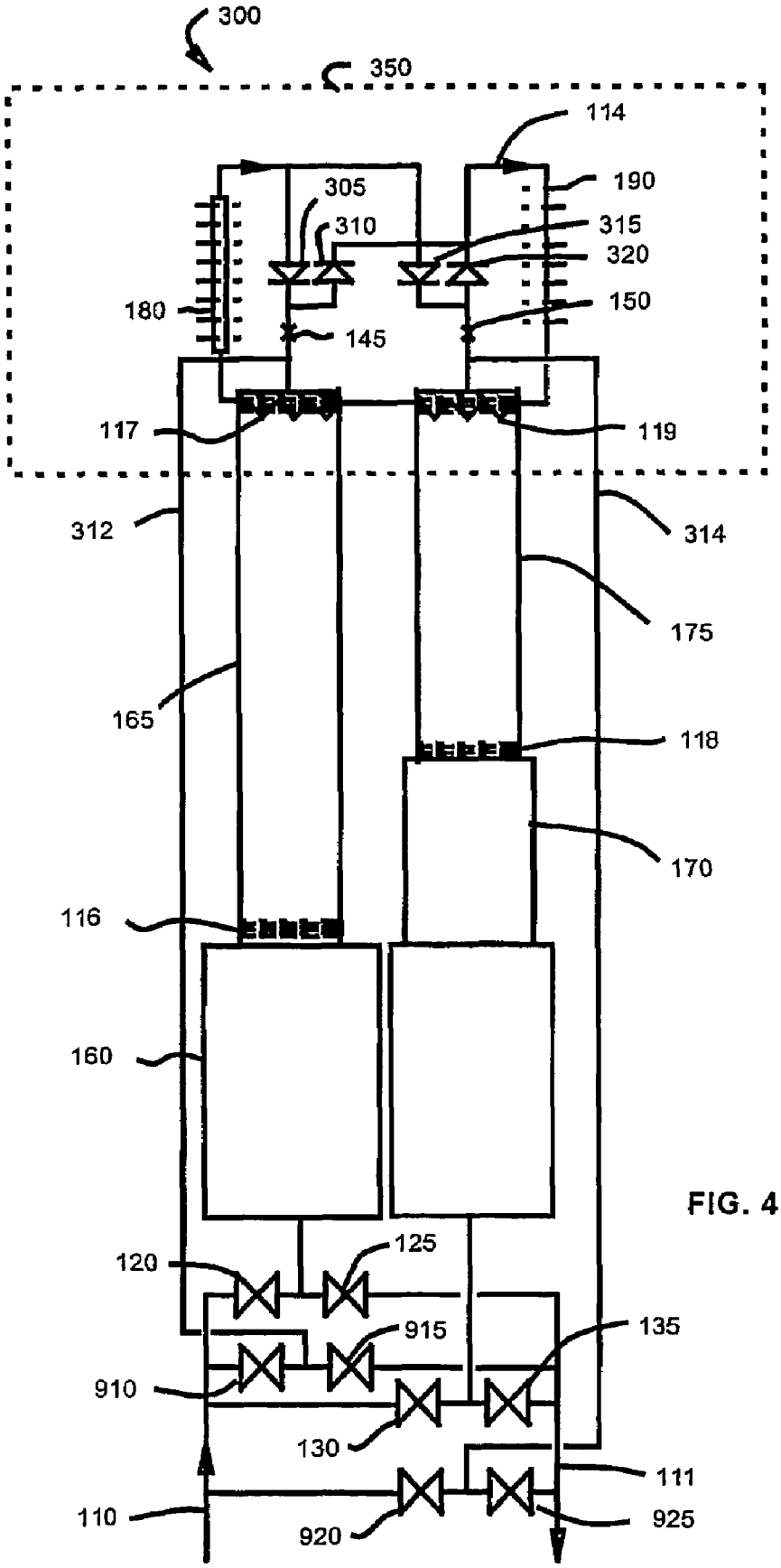
FIG. 4 is a schematic of a two stage inline pulse tube refrigerator with passive primary orifices, active by-pass valves, interphase control, and four check valves in the cooling channel to provide cooling by circulation of the buffer gas.

FIGS. 2, 3 and 4 show the application of the invention to two pulse tube refrigerators having one or two regenerators.

FIG. 2 shows a schematic of a two stage pulse tube refrigerator 200, including a connector tube 105, a first stage regenerator 160, and a first stage cold station 116, connected by piping 115, a first stage pulse tube 165, a second stage regenerator 170, a second stage cold station 118, a second stage pulse tube 175, a warm end assembly 250, inlet valve 120 connected to high pressure piping 110, and outlet valve 125 connected to low pressure piping 111. Warm end assembly 250 includes first stage hot station 117, second stage hot station 119, restrictors 140 and 155 in bypass channel 212, restrictor 145 in the line between hot station 117 and check valves 305, and 310, restrictor 150 in the line between hot station 119 and check valves 315, and 320, cooling channel 114, buffer tank 180, and cooling fins 190.

Connector tube 105 cycles gas in and out of the warm end of Regenerator 160 by virtue of alternately opening and closing valve 120 and valve 125 which are connected to the high pressure side of the compressor and low pressure side of the compressor through high pressure piping 110 and low pressure piping 111 respectively. Regenerator 160 would typically be packed with bronze or stainless steel screens and cold station 116 would typically be at a temperature of about 50 K. Regenerator 170 would typically be packed with bronze or stainless steel screens at the warm end and lead shot at the cold end. Cold station 118 would typically be at a temperature of about 15 K.

Bypass channel 212 connects the warm end of regenerator 160 with the hot ends of the pulse tubes through restrictors 140 and 155. Both pulse tubes operate in phase and share a common first stage regenerator 160. Restrictors 140 and 145 provide what is referred to as "double orifice" phase control for the first stage pulse tube 165, and restrictors 150 and 155 provide "double orifice" phase control for the second stage pulse tube 175.

In warm end assembly 250, the pulsating flow through restrictor 145 is rectified by check valves 305 and 310, and the pulsating flow through restrictor 150 is rectified by check valves 315 and 320. Flow through cooling channel 114, cooling fins 190, hot station 119, hot station 117, and buffer tank 180, and heat rejection, are the same as described for pulse tube refrigerator 100. The process by which refrigeration is produced in each pulse tube is also the same as for pulse tube refrigerator 100.

FIG. 3 shows a schematic of an inline two stage pulse tube refrigerator 300, including a first stage regenerator 160, and a first stage cold station 116, a first stage pulse tube 165, a second stage regenerator 170, a second stage cold station 118, a second stage Pulse tube 175, a hot end assembly 350, bypass channel 312, bypass channel 314, valve 120, valve 125, valve 130, valve 135, high pressure piping 110, and low pressure piping 111. Warm end assembly 350 includes first stage hot station 117, second stage hot station 119, restrictors 140, 145, 150, and 155, check valves 305, 310, 315, and 320, cooling channel 114, buffer tank 180, and cooling fins 190.

Gas cycles gas in and out of the warm end of regenerator 160 by virtue of alternately opening and closing valve 120 and valve 125 which are connected to the high pressure side of the compressor and low pressure side of the compressor through high pressure piping 110 and low pressure piping 111 respectively. Gas cycles in and out of the warm end of regenerator 170 by virtue of alternately opening and closing valve 130 and valve 135 which are connected to the high pressure side of the compressor and low pressure side of die compressor through high pressure piping 110 and low pressure piping 111 respectively. Gas cycling to the two regenerators is 180° out of phase. Regenerator 160 would typically be packed with bronze or stainless steel screens and cold station 116 would typically be at a temperature of about 50 K. Regenerator 170 would typically be packed with bronze or stainless steel screens in the warm section and lead shot in the cold section. Cold station 118 would typically be at a temperature of about 15 K.

Bypass channel 312 connects the warm end of regenerator 160 with the hot end of pulse tube 165 through restrictor 140 and bypass channel 314 connects the warm end of regenerator 170 with the hot end of pulse tube 175 through restrictor 155. Both pulse tubes operate out of phase. Restrictors 145 and 150 provide what is referred to as "interphase" control in conjunction with buffer tank 180 that makes up for the difference in gas that is transferred from each pulse tube. Second orifices restrictor 140 and restrictor 155 further improve the phase shifting to optimize the cycle efficiency.

In warm end assembly 350, the pulsating flow through restrictor 145 is rectified by 305 and 310, and the pulsating flow through restrictor 150 is rectified by 315 and 320. Flow through cooling channel 114, cooling fins 190, hot station 119, hot station 117, and BT 180, and heat rejection, are the same as described for Pulse tube refrigerator 100. The process by which refrigeration is produced within each pulse tube is also the same as for pulse tube refrigerator 100.

FIG. 4 shows another embodiment of the invention. FIG. 4 is a schematic of an alternative valve configuration of the inline two stage pulse tube of FIG. 3, including active valves 910 and 915, in place of passive valve 140, and active valves 920 and 925, in place of passive valve 155. This alternative valve configuration allows improved phasing of the gas flow in and out of the warm end of the pulse tube.

The invention claimed is:

1. In a two stage pulse tube refrigerator comprising a working gas, a compressor, two or more pulse tubes, in which the hot ends of the pulse tubes are remote from the line connecting the compressor to the warm end(s) of the regenerators, regenerators, and a buffer volume, the improvement comprising adding a passive rectification circuit to change the pulsating flow into and out of the buffer volume to circulating flow through the buffer volume where all of the circulating flow that enters the buffer volume flows through and, where the rectification circuit includes a cooling means, and wherein the circulating flow cools the hot ends of the pulse tubes.

2. The refrigerator of claim 1 where the rectification circuit includes one or more passive orifices at the hot ends of the pulse tubes through which the gas flows to achieve phase shifting.

3. In a two stage pulse tube refrigerator comprising a working gas, a compressor, two or more pulse tubes, in which the hot ends of the pulse tubes are remote from the line connecting the compressor to die warm end(s) of the regenerators, regenerators, and a buffer volume, the improvement comprising adding a passive rectification circuit to change the pulsating flow into and out of the buffer volume to circulating flow through the buffer volume, where the rectification circuit includes a cooling means, and wherein said passive rectification circuit is the buffer volume.

4. The refrigerator of claim 1 further comprising a double orifice control.

5. The refrigerator of claim 1 further comprising an interphase control.

6. The refrigerator of claim 1 further comprising a bypass channel connecting through restrictors the warm end of the regenerators with the hot ends of the pulse tubes.

7. The refrigerator of claim 1 where the rectification circuit includes cooling fins.

8. The refrigerator of claim 1 where the passive rectification comprises check valves.

* * * * *